US012571336B2

(12) United States Patent
Cruz

(10) Patent No.: US 12,571,336 B2
(45) Date of Patent: Mar. 10, 2026

(54) COMPUTER-IMPLEMENTED METHOD FOR DETECTING A FAULT IN A SELECTIVE CATALYTIC REDUCER ASSEMBLY

(71) Applicant: VOLVO TRUCK CORPORATION, Gothenburg (SE)

(72) Inventor: Jacob Raul Moreno Cruz, Herrljunga (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 18/665,758

(22) Filed: May 16, 2024

(65) Prior Publication Data

US 2024/0392716 A1 Nov. 28, 2024

(30) Foreign Application Priority Data

May 22, 2023 (EP) ..... 23174638
May 10, 2024 (EP) ..... 24175134

(51) Int. Cl.
*F01N 11/00* (2006.01)
*F01N 3/035* (2006.01)
(Continued)

(52) U.S. Cl.
CPC ..... *F01N 11/002* (2013.01); *F01N 3/035* (2013.01); *F01N 3/208* (2013.01); *F01N 13/009* (2014.06);
(Continued)

(58) Field of Classification Search
CPC ..... F01N 11/002; F01N 3/035; F01N 3/208; F01N 13/009; F01N 13/10;
(Continued)

(56) References Cited

U.S. PATENT DOCUMENTS

2012/0210700 A1* 8/2012 Sisken ..... F01N 3/2066 60/277
2016/0251995 A1* 9/2016 Tsunooka ..... F01N 11/005 701/33.7
(Continued)

FOREIGN PATENT DOCUMENTS

EP 4102036 A1 12/2022
KR 101749127 B1 6/2017

OTHER PUBLICATIONS

Extended European Search Report for EP Patent Application No. 23174638.9, mailed Oct. 12, 2023, 7 pages.
(Continued)

*Primary Examiner* — Brandon D Lee
(74) *Attorney, Agent, or Firm* — Sage Patent Group

(57) ABSTRACT

A computer-implemented method for detecting a fault in a selective catalytic reducer assembly of an internal combustion engine system includes: receiving, by processing circuitry of a computer system, upstream pressure information indicative of an exhaust gas pressure at a position upstream the diesel particulate filter, as seen in an intended direction of flow from the internal combustion engine to the diesel particulate filter; receiving, by the processing circuitry, pressure difference information indicative of a pressure difference across the diesel particulate filter; and using, by the processing circuitry, the upstream pressure information and the pressure difference information to determine whether or not a fault has occurred in the exhaust selective catalytic reducer assembly.

13 Claims, 5 Drawing Sheets

(51) Int. Cl.
*F01N 3/20* (2006.01)
*F01N 13/00* (2010.01)
*F01N 13/10* (2010.01)

(52) U.S. Cl.
CPC ..... *F01N 13/10* (2013.01); *F01N 2550/02* (2013.01); *F01N 2610/02* (2013.01); *F01N 2610/1453* (2013.01); *F01N 2900/0414* (2013.01); *F01N 2900/1406* (2013.01)

(58) Field of Classification Search
CPC ..... F01N 2550/02; F01N 2610/02; F01N 2610/1453; F01N 2900/0414; F01N 2900/1406; F01N 2560/06; F01N 2560/08; F01N 2610/00; F01N 9/005; F01N 11/005; F01N 9/002; Y02T 10/12
See application file for complete search history.

(56) References Cited

U.S. PATENT DOCUMENTS

| | | | | |
|---|---|---|---|---|
| 2017/0152785 | A1* | 6/2017 | Lugo-Castillo | F01N 3/206 |
| 2017/0175605 | A1* | 6/2017 | Hagimoto | B01D 46/0027 |
| 2018/0306082 | A1* | 10/2018 | Hoyos Velasco | F01N 11/007 |
| 2023/0123398 | A1 | 4/2023 | Amiri et al. | |
| 2023/0287841 | A1* | 9/2023 | Sundararajan | F01N 3/023 |

OTHER PUBLICATIONS

Extended European Search Report for EP Patent Application No. 24175134.6, mailed Sep. 16, 2024, 6 pages.

* cited by examiner

COMPUTER-IMPLEMENTED METHOD FOR DETECTING A FAULT IN A SELECTIVE CATALYTIC REDUCER ASSEMBLY

CROSS REFERENCE TO RELATED APPLICATIONS

This application claims priority to European Patent Application Number 23174638.9, filed on May 22, 2023 and European Patent Application Number 24175134.6, filed on May 10, 2024, the disclosures and content of which are incorporated by reference herein in their entireties.

TECHNICAL FIELD

The disclosure relates generally to fault detection. In particular aspects relate to a method for detecting a fault in a selective catalytic reducer assembly of an internal combustion engine system. The engine system may be applied to heavy-duty vehicles, such as trucks, buses, and construction equipment. Although the disclosure may be described with respect to a particular vehicle, the disclosure is not restricted to any particular vehicle.

BACKGROUND

Selective catalytic reduction is a means of converting nitrogen oxides, also referred to as $NO_x$ with the aid of a catalyst and heat into diatomic nitrogen ($N_2$), and water ($H_2O$). A reductant, such as a urea ($CO(NH_2)_2$) solution, is added to a stream of flue or exhaust gas and is reacted onto a Selective Catalytic Reducer (SCR). As the reaction drives toward completion, nitrogen ($N_2$), and carbon dioxide ($CO_2$), in the case of urea use, are produced. Many conventional systems utilize Diesel Exhaust Fluid (DEF), which typically is a urea-water solution. To convert the DEF into $NH_3$, the DEF is injected into a decomposition tube or a mix box through which an exhaust stream flows. The injected DEF spray is heated by the exhaust gas stream to vaporize the urea-water solution and trigger the decomposition of urea into $NH_3$. The exhaust gas mixture, including the $NH_3$ decomposed from the urea, further mixes while flowing through the decomposition tube and passes over the SCR catalyst, where the $NO_x$ and $NH_3$ are converted primarily to $N_2$ and $H_2O$.

The selective catalytic reduction technique is considered to be the most efficient way for NOx reduction in diesel engines of e.g., heavy trucks, ships, locomotives gas turbines and automobiles. Typically, these engines are provided with an exhaust aftertreatment system, which comprises a selective catalytic reducer assembly having at least one selective catalytic reducer and possibly also a urea mix box.

Under certain conditions, for instance, when the temperatures are not high enough for conversion of urea to NH3, or when more urea is released into the exhaust stream than required, there may be a possibility of build-up of solids in the exhaust pipes and near the spray modules of the selective catalytic reducer assembly. Due to this build-up, the flow of exhaust gas through the exhaust aftertreatment system is restricted and there may arise problems like increase in backpressure, release of ammonia into the atmosphere, raised levels of NOx output and increased fuel consumption etc.

SUMMARY

According to a first aspect of the disclosure, a computer-implemented method for detecting a fault in a selective catalytic reducer assembly of an internal combustion engine system is provided. The internal combustion engine system comprises an internal combustion engine and an exhaust aftertreatment system, the exhaust aftertreatment system comprising:

- a diesel particulate filter adapted to receive exhaust gas from the internal combustion engine, and
- the selective catalytic reducer assembly positioned downstream the diesel particulate filter, as seen in an intended direction of flow from the internal combustion engine to the selective catalytic reducer assembly, the selective catalytic reducer assembly comprising a selective catalytic reducer, the method comprises:

- receiving, by processing circuitry of a computer system, upstream pressure information indicative of an exhaust gas pressure at a position upstream the diesel particulate filter, as seen in an intended direction of flow from the internal combustion engine to the diesel particulate filter;
- receiving, by the processing circuitry, pressure difference information indicative of a pressure difference across the diesel particulate filter,
- using, by the processing circuitry, the upstream pressure information and the pressure difference information to determine whether or not a fault has occurred in the exhaust selective catalytic reducer assembly.

The first aspect of the disclosure may seek to identify the fault in an engine system. For instance, by using the above information, it may be possible to pinpoint that the fault has occurred in the selective catalytic reducer assembly. A technical benefit may include more efficient maintenance of the engine system.

Optionally in some examples, including in at least one preferred example, the selective catalytic reducer assembly further comprises a urea mix box into which urea is adapted to be injected, the urea mix box being positioned between the diesel particulate filter and the selective catalytic reducer, as seen in an intended direction of flow from the diesel particulate filter to the selective catalytic reducer.

Optionally in some examples, including in at least one preferred example, the internal combustion engine system comprises an exhaust gas manifold located between the internal combustion engine and the diesel particulate filter, as seen in an intended direction of flow from the internal combustion engine to the diesel particulate filter, the upstream pressure information being indicative of an exhaust gas pressure in the exhaust gas manifold.

Optionally in some examples, including in at least one preferred example, using the upstream pressure information and the pressure difference information to determine whether or not a fault has occurred in the selective catalytic reducer assembly comprises:

- using the upstream pressure information for determining an upstream pressure change rate value indicative of a rate of change of the exhaust gas pressure at the position upstream the diesel particulate filter,
- using the pressure difference information for determining a pressure difference change rate value indicative of a rate of change of the pressure difference across the diesel particulate filter,
- using the upstream pressure change rate value and the pressure difference change rate value for determining whether or not a fault has occurred in the selective catalytic reducer assembly.

Typically, the pressure difference across the diesel particulate filter may be proportional to a mass flow of the exhaust gas, and the accumulation of a soot level built up inside the diesel particulate filter. Similarly, the exhaust gas pressure upstream the diesel particulate filter may also correlate with the mass flow of the exhaust gas, and the load of soot in the exhaust gas. In other words, under normal conditions with no faults in the selective catalytic reducer assembly, the pressure difference across the diesel particulate filter may change at substantially a same rate, or at least at a similarly rate with the exhaust gas pressure at a position upstream the diesel particulate filter. Accordingly, by use of the above information, it may allow for detection of faults in the selective catalytic reducer assembly. A technical benefit may include detection of the fault within the selective catalytic reducer assembly.

Optionally in some examples, including in at least one preferred example, the method comprises in response to determining that a difference between the upstream pressure change rate value and the upstream pressure change rate value exceeds a predetermined threshold value, determining that a fault has occurred in the selective catalytic reducer assembly. A technical benefit may include that the fault may be determined in a straightforward way.

Optionally in some examples, including in at least one preferred example, using the upstream pressure information and the pressure difference information to determine whether or not a fault has occurred in the selective catalytic reducer assembly comprises:

determining an expected pressure difference information indicative of a pressure difference across the diesel particulate filter under a condition in which the selective catalytic reducer assembly is not associated with the fault, in response to determining that a difference between the pressure difference information and the expected pressure difference information being outside a predetermined difference range, determining that a fault has occurred in the selective catalytic reducer assembly.

By use of the expected pressure difference information, it may allow for detection of faults in the selective catalytic reducer assembly. A technical benefit may include detection of the fault within the selective catalytic reducer assembly.

Optionally in some examples, including in at least one preferred example, the expected pressure difference information is determined using an expected pressure downstream the diesel particulate filter determined using a selective catalytic reducer assembly flow model of at least a portion of the selective catalytic reducer assembly.

Optionally in some examples, including in at least one preferred example, the selective catalytic reducer assembly flow model is adapted to determine the expected pressure downstream the diesel particulate filter and preferably upstream the selective catalytic reducer assembly, at the condition in which the selective catalytic reducer assembly is not associated with the fault, the selective catalytic reducer assembly flow model being adapted to use: gas mass information indicative of a gas mass flow through the exhaust aftertreatment system, temperature information indicative of an exhaust gas temperature at a position downstream the diesel particulate filter, a pressure downstream the at least a portion of the selective catalytic reducer assembly and flow resistance information indicative of a flow resistance across at least a portion of the selective catalytic reducer assembly at the condition in which the selective catalytic reducer assembly is not associated with the fault. A technical benefit may include that an accurate expected pressure downstream the diesel particulate filter when operated under the condition in which the selective catalytic reducer assembly is not associated with the fault May be determined in a relatively fast manner.

Optionally in some examples, including in at least one preferred example, the expected pressure difference information is determined using a difference between a pressure upstream the diesel particulate filter and the expected pressure downstream the diesel particulate filter.

Optionally in some examples, including in at least one preferred example, the pressure upstream the diesel particulate filter is determined using the upstream pressure information indicative of an exhaust gas pressure at a position upstream the diesel particulate filter.

Optionally in some examples, including in at least one preferred example, the pressure upstream the diesel particulate filter is an expected pressure upstream the diesel particulate filter which is determined using the upstream pressure information and an upstream flow model of at least a portion of the internal combustion engine system being located between a position at which the exhaust gas pressure is determined and the diesel particulate filter.

Purely by way of example, the exhaust gas pressure may be determined at the exhaust gas manifold. In some other examples where a pressure-altering component, such as a turbine, is arranged downstream the internal combustion engine, the exhaust gas pressure may be determined at a position between the turbine and the diesel particulate filter. By appropriately determining the exhaust gas pressure, appropriate upstream pressure information may be used which may be less sensitive to pressure fluctuations that may arise between the engine and the diesel particulate filter. A technical benefit may include that a more accurate expected pressure upstream the diesel particulate filter may be determined.

Optionally in some examples, including in at least one preferred example, the upstream flow model is adapted to use: gas mass information indicative of a gas mass flow through the exhaust aftertreatment system, temperature information indicative of an exhaust gas temperature at a position upstream the diesel particulate filter, the upstream pressure information and flow resistance information indicative of a flow resistance across the portion of the internal combustion engine system being located between the position at which the an exhaust gas pressure is determined and the diesel particulate filter. A technical benefit may include that an appropriately accurate pressure upstream the diesel particulate filter may be determined in a relatively fast manner.

Optionally in some examples, including in at least one preferred example, the pressure difference information is received from a differential pressure sensor comprising:

a first sensor part positioned upstream, preferably at an entrance of, the diesel particulate filter and configured to measure an upstream pressure of the exhaust gas entering the diesel particulate filter;

a second sensor part positioned downstream, preferably at an exit of, the diesel particulate filter and configured to measure a downstream pressure of the exhaust gas exiting the diesel particulate filter, wherein the differential pressure sensor is configured to output a pressure difference being the difference between the upstream pressure and the downstream pressure.

Optionally in some examples, including in at least one preferred example, the fault is related to clogging in a portion of the selective catalytic reducer assembly due to a deposition of components, preferably a deposition of solids, inside that portion.

According to a second aspect of the disclosure, a computer program product is provided. The computer program product comprises program code for performing, when executed by the processing circuitry, the method according to the first aspect of the present disclosure.

According to a third aspect of the disclosure, a non-transitory computer-readable storage medium is provided. The non-transitory computer-readable storage medium comprises instructions, which when executed by the processing circuitry, cause the processing circuitry to perform the method according to the first aspect of the present disclosure.

The disclosed aspects, examples (including any preferred examples), and/or accompanying claims may be suitably combined with each other as would be apparent to anyone of ordinary skill in the art. Additional features and advantages are disclosed in the following description, claims, and drawings, and in part will be readily apparent therefrom to those skilled in the art or recognized by practicing the disclosure as described herein.

BRIEF DESCRIPTION OF THE DRAWINGS

Examples are described in more detail below with reference to the appended drawings.

DETAILED DESCRIPTION

The detailed description set forth below provides information and examples of the disclosed technology with sufficient detail to enable those skilled in the art to practice the disclosure.

Figure 1:
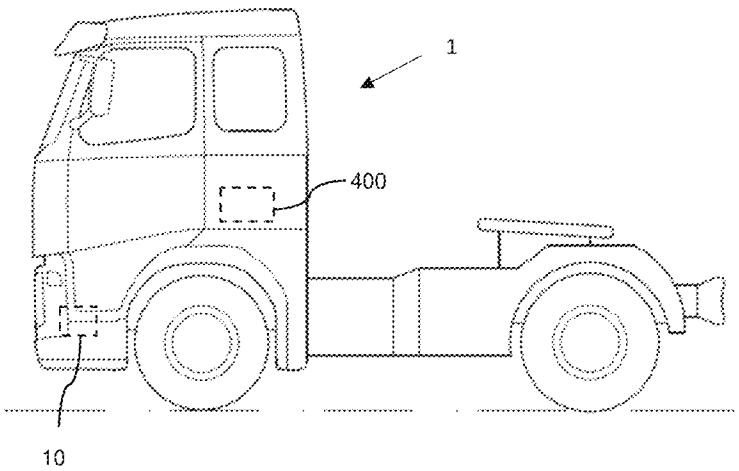
FIG. 1 is an exemplary vehicle.

FIG. 1 depicts a vehicle 1, which is exemplified by a truck. Even though a truck is shown, it shall be noted that the disclosure is not limited to this type of vehicle, but it may also be used for other vehicles, such as a bus, or construction equipment, e.g., a wheel loader or an excavator. In some examples, the vehicle may be a marine vessel, e.g., a ship or a boat.

Figure 2:
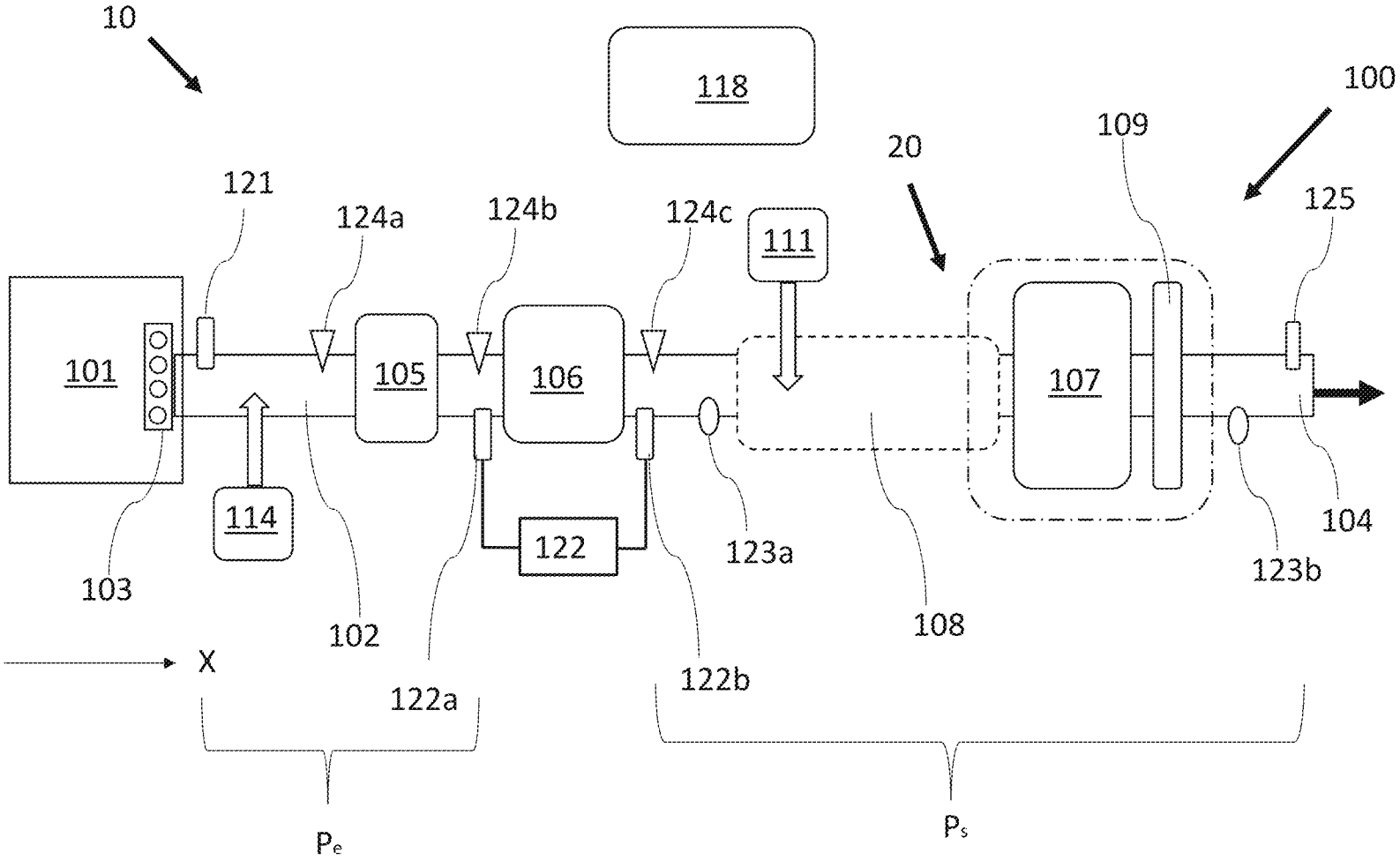
FIG. 2 is a schematic diagram illustrating an engine system in a vehicle.

The vehicle 1 comprises an engine system 10, which is elaborated upon in detail in FIG. 2. The engine system 10 comprises an internal combustion engine 101 for providing propulsion power for propelling the vehicle 1. The internal combustion engine 101 may be of any suitable type, for instance, a diesel engine. The engine system 10 further comprises an exhaust gas aftertreatment system 100, configured to treat the exhaust gases exiting the internal combustion engine 101, in order to reduce harmful emissions to the environment.

The exhaust aftertreatment system 110 comprises a diesel particulate filter (DPF) 106 adapted to receive exhaust gas from the internal combustion engine 101, for instance, from an exhaust gas manifold 103 located between the internal combustion engine 101 and the diesel particulate filter 106, as seen in an intended direction X of flow from the internal combustion engine 101 to the diesel particulate filter 106. The exhaust aftertreatment system 110 further comprises a selective catalytic reducer assembly 20 positioned downstream the diesel particulate filter 106, as seen in an intended direction X of flow from the internal combustion engine 101 to the selective catalytic reducer assembly 20. The selective catalytic reducer assembly 20 comprises a selective catalytic reducer (SCR) 107. The selective catalytic reducer assembly 20 may further comprise a urea mix box 108 into which urea is adapted to be injected. The urea mix box 108 may be positioned between the DPF 106 and the SCR 107, as seen in an intended direction X of flow from the diesel particulate filter 106 to the SCR 107. In some examples, the exhaust aftertreatment system 110 may further comprise a Diesel Oxidation Catalyst (DOC) 105 which may be positioned between the internal combustion engine 101 and the diesel particulate filter 106. Each one of the DOC 105, DPF 106 and SCR 107 components are configured to perform a particular exhaust emissions treatment operation on the exhaust gas passing through or over the respective components.

In some examples, a urea dosing system (UDS) 111 may also be provided upstream of the SCR 107 for injecting diesel exhaust fluid (DEF) upstream of the SCR 107. Advantageously, the UDS 111 may inject DEF into the urea mix box 108 of the selective catalytic reducer assembly 20. The mix box 108 may comprise an inlet pipe, through which exhaust gas enters a mixing chamber. After being mixed with DEF, the exhaust gas leaves the mixing chamber through an outlet pipe connected to the SCR 107. The inlet and outlet pipes may form an angle, preferably at least 90°. The mixing chamber may comprise an opening, adapted to receive a nozzle by means of which the DEF can be introduced into the mixing chamber. The urea mix box 108 may advantageously have an interior design to induce turbulence in the exhaust gas flow entering the mixing chamber, thereby enhancing mixing of the exhaust gas with the reducing agent DEF before it enters the SCR 107.

Moreover, in some examples, the exhaust aftertreatment system 100 may also include an Aftertreatment Hydrocarbon Injector (AHI) 114 configured to inject hydrocarbons into an exhaust flow path 102 upstream of the DOC 105. The injected hydrocarbons oxidize over the DOC 105 to raise the temperature of the exhaust gas passing therethrough. The temperature of the exhaust gas is advantageously periodically raised even further in order to induce active regeneration of the DPF 106 to burn off soot and other particulate matter that have accumulated inside the DPF 106. Furthermore, the exhaust aftertreatment system 100 may advantageously also comprise an ammonia slip catalyst 109 arranged downstream of the SCR 107. The task of the ammonia slip catalyst 109 is the selective oxidation of the ammonia slip (NH3) to harmless nitrogen gas (N2) and water (H2O) and therefore avoiding smell and health risks.

Generally, during operation of an exhaust after treatment system 101, the exhaust gas leaves the engine 101 and enters the DOC 105 wherein the amount of carbon monoxide (CO) and hydrocarbons (HCs) present in the exhaust gas are reduced via oxidation techniques. The DOC 105 may also convert NO to NO2 for passive regeneration of soot on a DPF 106 and to facilitate fast SCR reactions. Thereafter, the exhaust enters the DPF 106 which filters and traps particulate matter, including soot, present in the exhaust gas. Finally, the exhaust continues through the SCR 107 and ammonia slip catalyst 109 wherein NOx emissions are reduced.

The exhaust aftertreatment system 100 may further comprises a plurality of sensor devices which are in operative communication with a control unit 400 comprised in the vehicle 1 (see FIG. 1). The control unit 400 may be an electronic control unit and may comprise processing circuitry 402, which is adapted to run a computer program as disclosed herein. The control unit 400 may comprise hardware and/or software for performing the method according to the present disclosure. In an example, the control unit 400 may be denoted a computer. The control unit 400 may be constituted by one or more separate sub-control units. In addition, the control unit 400 may communicate by use of wired and/or wireless communication means.

In the shown example, the exhaust aftertreatment system 100 may be throughout the exhaust flow provided with pressure sensors, temperature sensors and NOx sensors that will confirm and regulate proper operation of each of the components in the exhaust aftertreatment system 100. More specifically, a number of temperature sensors 124*a*, 124*b*, 124*c* may be located along the exhaust flow path 102 with a first temperature sensor 124*a* located upstream of the DOC 105, a second temperature sensor 124*b* located upstream the DPF 106, and a third temperature sensor 124*c* located downstream the DPF 106. Moreover, a first pressure sensor 121 may be provided and positioned at the exit of the exhaust manifold 103. The first pressure sensor 121 may monitor an absolute value of the exhaust gas pressure $P_{121}$ including the soot and particulate matter load present in the exhaust. The engine exhaust gas pressure $P_{121}$ is to provide upstream pressure information indicative an exhaust gas pressure $P_{121}$ at a position upstream the PDF 106. Although in the shown example, the first pressure sensor 121 is placed at the exit of the exhaust manifold 103, it may alternatively be placed at any suitable location between the internal combustion engine 101 and the DPF 106, preferably at a position that may provide the upstream pressure information that may minimize sensitivity to any pressure fluctuations that may arise between the DPF 106 and the internal combustion engine 101. Purely by way of example, in case a pressure-altering component, such as a turbine, is present in the exhaust aftertreatment system 100, the first pressure sensor 121 may be placed between the turbine and the DPF 106. A second sensor 122 in the form of a differential sensor may be positioned across the DPF 106 and is responsible for measuring a difference ΔP across the DPF 106. The second sensor 122, in some examples, may have a first sensor part 122*a* positioned upstream the DPF 106 which measures the pressure $P_{122a}$ of the exhaust gas entering the DPF 106, and a second sensor part 122*b* positioned downstream of the DPF 106 at the exit of the DPF 106 which measures the pressure $P_{122b\ of}$ the exhaust gas exiting the DPF 106. A third pressure sensor 125 may be positioned at the exit of the exhaust flow path 102 downstream of all exhaust aftertreatment devices. The third pressure sensor monitors the atmospheric pressure $P_{125}$ surrounding the exhaust aftertreatment system 100.

Figure 3:
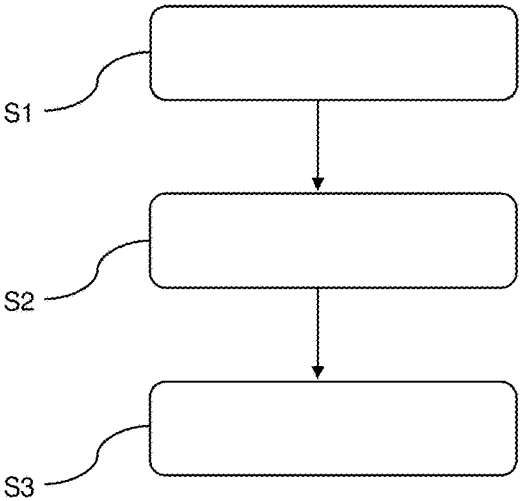
FIG. 3 is a flow chart illustrating a method for detecting a fault in a selective catalytic reducer assembly of an internal combustion engine system.

When the exhaust aftertreatment system 100 is operated under a temperature that is not high enough for conversion of urea to NH3, or if more urea is released into the exhaust stream than required, there may be a possibility of build-up of solids in a portion of the selective catalytic reducer assembly 20, such as an exhaust pipe or a portion near the urea dosing system 111 of the selective catalytic reducer assembly 20. As a result, a fault may occur in the selective catalytic reducer assembly 20. FIG. 3 illustrates a method for detecting a fault in a selective catalytic reducer assembly 20 of an internal combustion engine system 10, for example, to detect a fault that is related to clogging in a portion of the selective catalytic reducer assembly 20 due to a deposition of components, preferably a deposition of solids, inside that portion. It should also be noted that the method may also be able to detect other types of faults associated with the selective catalytic reducer assembly 20. Purely by way of example, the method may be able to detect a fault associated with an impairment of the flow through the selective catalytic reducer assembly 20. Purely by way of example, the method may be able to detect a constriction associated with a reduction of flow through the selective catalytic reducer assembly 20. The method may be performed by the control system 400, such as processing circuitry of a computer system 400. The method comprises the actions listed in the following, which, unless otherwise indicated, may be taken in any suitable order.

S1: receiving upstream pressure information indicative of an exhaust gas pressure $P_{121}$ at a position upstream the diesel particulate filter 106, as seen in an intended direction of flow from the internal combustion engine 101 to the diesel particulate filter 106. This upstream pressure information may be received from the first pressure sensor 121.

S2: receiving pressure difference information indicative of a pressure difference ΔP across the diesel particulate filter 106. The information may be received from the second sensor 122.

S3: using the upstream pressure information and the pressure difference information to determine whether or not a fault has occurred in the exhaust selective catalytic reducer assembly 20.

Figure 4B:
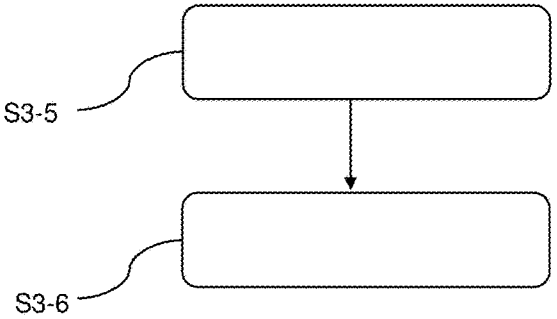
FIG. 4*a* and FIG. 4*b* are flow charts illustrating optional steps of the method of FIG. 3.
Figure 4A:
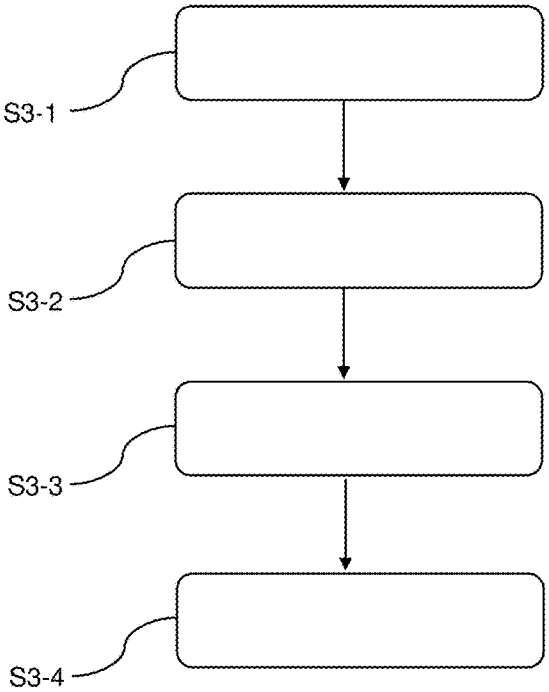

In some examples, the method may further comprise the following actions as illustrated in FIG. 4*a:*

- S3-1: using the upstream pressure information for determining an upstream pressure change rate value indicative of a rate of change of the exhaust gas pressure at the position upstream the diesel particulate filter,
- S3-2: using the pressure difference information for determining a pressure difference change rate value indicative of a rate of change of the pressure difference across the diesel particulate filter 106,
- S3-3: using the upstream pressure change rate value and the pressure difference change rate value for determining whether or not a fault has occurred in the selective catalytic reducer assembly 20.
- S3-4: in response to determining that a difference between the upstream pressure change rate value and the upstream pressure change rate value exceeds a predetermined threshold value, determining that a fault has occurred in the selective catalytic reducer assembly 20.

Typically, the pressure difference across the diesel particulate filter may be proportional to a mass flow of the exhaust gas, and the accumulation of a soot level built up inside the diesel particulate filter. Similarly, the exhaust gas pressure upstream the diesel particulate filter may correlate with the mass flow of the exhaust gas, and the load of soot in the exhaust gas. This means that under normal conditions with no faults in the selective catalytic reducer assembly, the pressure difference across the DPF 106 may change at substantially a same rate, or at least at a similarly rate with changes in the exhaust gas pressure at a position upstream the diesel particulate filter 106. As such, if the difference between the upstream pressure change rate value and the upstream pressure change rate value exceeds a predetermined threshold value, it may be determined that a fault has fault has occurred in the selective catalytic reducer assembly 20.

Figures 5A, 5B:
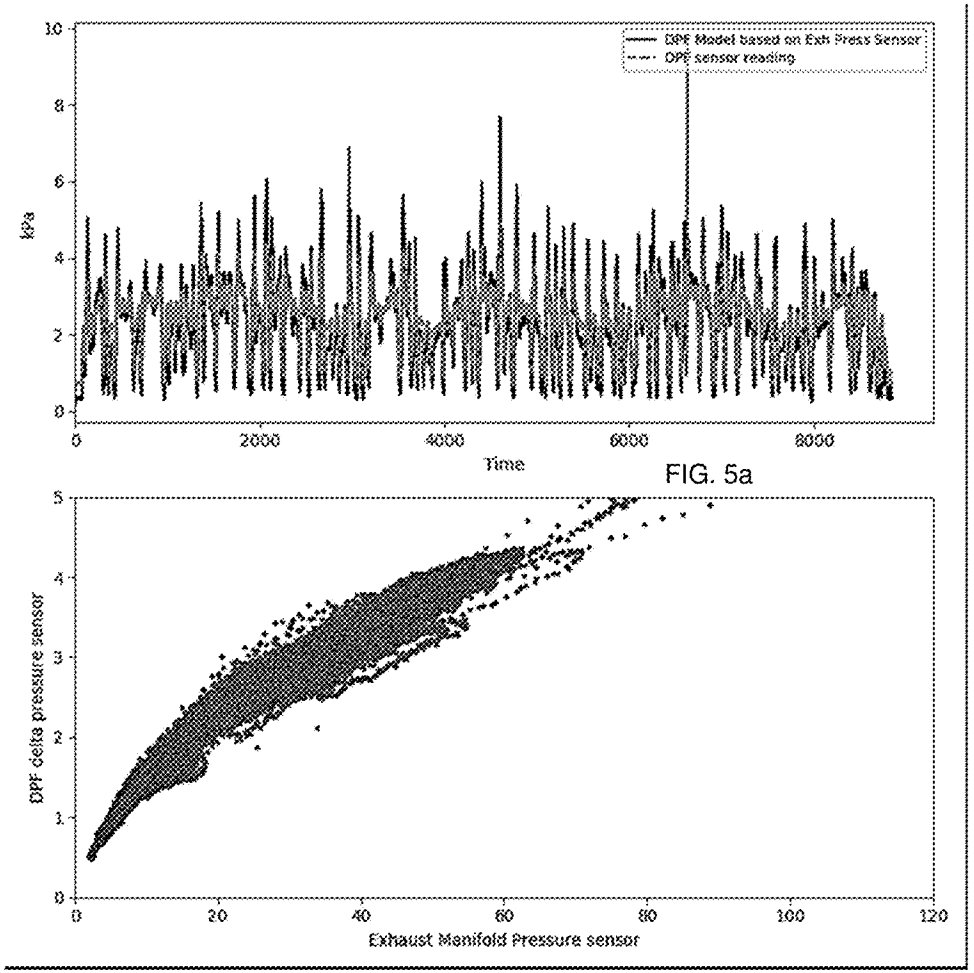
FIG. 5*a* illustrates a graph of an expected pressure difference across the diesel particulate filter together with a measured pressure difference during operation of an engine at a condition under which no faults have occurred in the selective catalytic reducer assembly.
FIG. 5*b* illustrates a scatter plot of a pressure difference across the diesel particulate filter and a measured exhaust gas pressure during operation of an engine at a condition under which no faults have occurred in the selective catalytic reducer assembly.
Figures 6A, 6B:
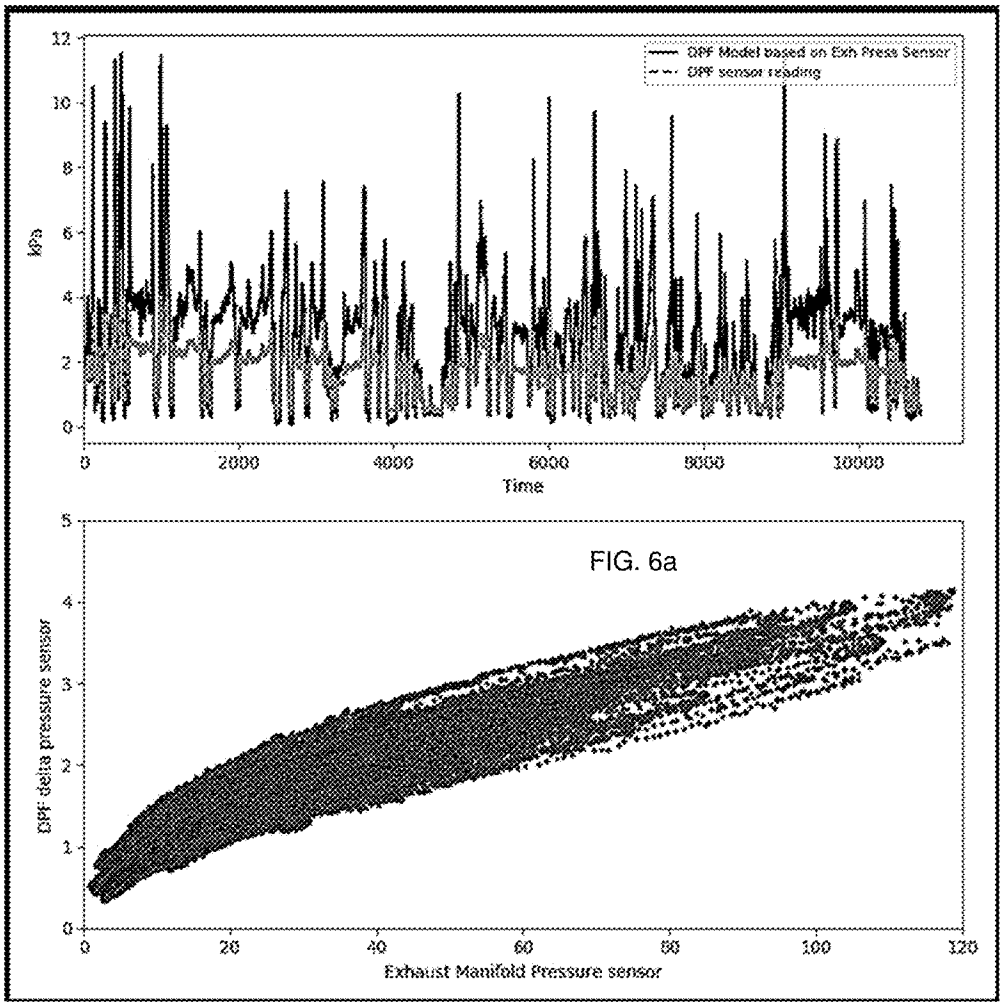
FIG. 6*a* illustrates a graph of an expected pressure difference across the diesel particulate filter together with a measured pressure difference during operation of an engine at a condition where a fault has occurred in the selective catalytic reducer assembly.
FIG. 6*b* illustrates a scatter plot of a pressure difference across the diesel particulate filter and a measured exhaust gas pressure during operation of an engine at a condition where a fault has occurred in the selective catalytic reducer assembly.

FIG. 5*b* illustrates a scatter plot of a measured pressure difference ΔP across the diesel particulate filter 106 and a measured exhaust gas pressure $P_{121}$ at a condition under which no faults have occurred in the selective catalytic reducer assembly 20, while FIG. 6*b* shows this correlation at a condition under which a fault has occurred in the selective catalytic reducer assembly 20. The horizontal axis represents measured exhaust gas pressure $P_{121}$ and the vertical axis represents measured pressure difference ΔP. It is clearly seen from FIG. 5*b* that the pressure difference ΔP increases at a similar rate as the exhaust gas pressure $P_{121}$, and FIG. 6*b* shows that the exhaust gas pressure $P_{121}$ is increasing faster than the pressure difference ΔP.

In some other examples, the method may further comprise the following actions as illustrated in FIG. 4*b:*

- S3-5: determining an expected pressure difference information indicative of a pressure difference ΔP' across the diesel particulate filter 106 under a condition in which the selective catalytic reducer assembly 20 is not associated with the fault.
- S3-6: in response to determining that a difference between the pressure difference information and the expected pressure difference information being outside a predetermined difference range, determining that a fault has occurred in the selective catalytic reducer assembly 20.

In some examples, the expected pressure difference information is determined using an expected pressure $P_{122b'}$ downstream the diesel particulate filter 106, whereby the expected pressure $P_{122b'}$ may be determined using a selective catalytic reducer assembly flow model of at least a portion of the selective catalytic reducer assembly 20. Moreover, the expected pressure difference information is determined using a difference between a pressure upstream the diesel particulate filter 106, for instance, an expected pressure $P_{122a'}$ upstream the diesel particulate filter 106 and the expected pressure $P_{122b'}$ downstream the diesel particulate filter 106. The expected pressure $P_{122a}$ upstream the diesel particulate filter 106 may be determined using the upstream pressure information and an upstream flow model of at least a portion of the internal combustion engine system 10 being located between a position at which the exhaust gas pressure $P_{121}$ is determined and the diesel particulate filter 106. Purely by way of example, the exhaust gas pressure may be determined at the exhaust gas manifold 103 using the first pressure sensor 121, as shown in FIG. 2. However, in some other examples, especially if a pressure-altering component, such as a turbine (not shown), is arranged downstream the internal combustion engine 101, the exhaust gas pressure may be determined at a position between the turbine (not shown) and the diesel particulate filter 106.

Flow Model Background

In the following, the selective catalytic reducer assembly 20 is modelled as a valve whose flow coefficient $K_{scr}$ will change as solid deposits grow, making the cross-sectional area inside the urea mix box 108 and/or SCR 107 smaller. Although there is no valve in the system, the restriction inside the mix box 108 and/or SCR 107 may be thought of as a valve which slowly closes as the restriction increases due to build-up of deposits inside the urea mix box 108 and/or SCR 107 of the selective catalytic reducer assembly 20.

The valve flow model is assumed to be of incompressible fluid or gas in a non-chocked condition, and therefore the volumetric flow can be estimated by $$Q = \frac{K_v}{\sqrt{\rho / 1000 \Delta p}}$$

where $K_v$ is the flow coefficient of the specific valve

ρ is the gas density

Δp is pressure drop $p_{in} - p_{out}$ in bar

Substituting $$Q = \frac{\dot{m}}{\rho}$$

where ṁ is the flow rate in kg/h $$\rho = \frac{10^5 p_{in}}{RT}$$

where R is the gas constant and T is the temperature in K

Solving for $p_{in}$ $$p_{in} = \frac{1}{2}\left(p_{out} \mp \sqrt{p_{out}^2 + \frac{4RT\dot{m}^2}{10^8 K_v^2}}\right)$$

Assuming that $p_{in} \geq p_{out}$ and replacing ṁ by its kg/s equivalent $$p_{in} = \frac{1}{2}\left(p_{out} + \sqrt{p_{out}^2 + \frac{4RT\dot{m}^2 3600^2}{10^8 K_v^2}}\right)$$

The calculation of $$\frac{3600^2 4R}{10^8}$$

Where R=287 can be simplified as C=148.7808 which gives $$p_{in} = \frac{1}{2}\left(p_{out} + \sqrt{p_{out}^2 + \frac{CT\dot{m}^2}{K_v^2}}\right)$$

In FIG. 2 the exhaust aftertreatment system 100 has been divided into two portions: namely an "internal combustion engine portion" ($P_e$) which is upstream the DPF 106 and a "selective catalytic reducer assembly portion" ($P_s$) which is downstream the DPF 106. Accordingly, an upstream flow model and a selective catalytic reducer assembly flow model is derived as follows:

The selective catalytic reducer assembly flow model may be expressed as:

$$P_{122b'} = \frac{1}{2}\left(P_{125} + \sqrt{P_{125}^2 + \frac{CT_{124c}\dot{m}^2}{K_{scr}^2}}\right)$$

where $P_{122b'}$ is an expected pressure downstream the diesel particulate filter 106 under a condition in which the selective catalytic reducer assembly 20 is not associated with the fault, $P_{125}$ is the atmospheric pressure which may be measured by the third sensor 125, T124*c* is the temperature which may be measured in ° Kelvin by the third temperature sensor 124*c* located at the exit of the DPF 106, m is a flow rate indicating gas mass flow through the exhaust aftertreatment system 100 and C may be seen as a constant C=148.7808. Moreover, Kscr is the flow coefficient of the selective catalytic reducer assembly portion $P_s$. The flow coefficient Kscr may measure mass per unit time at a certain temperature of a gas flowing in the selective catalytic reducer assembly portion $P_s$, and as discussed, it may change as solid deposits grow inside the mix box 108 and/or SCR 107, meaning that the flow coefficient Kscr is dependent on a flow resistance inside the selective catalytic reducer assembly portion $P_s$. To this end, it may be concluded that the selective catalytic reducer assembly flow model is adapted to determine the expected pressure $P_{122b'}$ downstream the diesel particulate filter 106 and preferably upstream the selective catalytic reducer assembly 20, at the condition in which the selective catalytic reducer assembly 20 is not associated with the fault. As such, the flow coefficient Kscr of the selective catalytic reducer assembly portion $P_s$ may be associated with the selective catalytic reducer assembly 20 at a condition in which the selective catalytic reducer assembly 20 is not associated with any fault. As indicated in the above equation, the selective catalytic reducer assembly 20 flow model may be adapted to use: gas mass information indicative of a gas mass flow through the exhaust aftertreatment system 100, temperature information T124*c* indicative of an exhaust gas temperature at a position downstream the diesel particulate filter 106, a pressure P125 downstream the at least a portion of the selective catalytic reducer assembly 20 and flow resistance information indicative of a flow resistance across at least a portion of the selective catalytic reducer assembly 20 at the condition in which the selective catalytic reducer assembly 20 is not associated with the fault.

Moreover, the upstream flow model may be expressed as:

$$P_{121} = \frac{1}{2}\left(P_{122a'} + \sqrt{P_{122a'}^2 + \frac{CT_{124a}\dot{m}^2}{K_{engine}^2}}\right)$$

$P_{122a'}$ is an expected pressure upstream the diesel particulate filter 106 under a condition in which the selective catalytic reducer assembly 20 is not associated with the fault.

$P_{121}$ is the upstream pressure information indicative of an exhaust gas pressure $P_{121}$ at a position upstream the diesel particulate filter 106. For instance, $P_{121}$ may be obtained from the measurement of the first pressure sensor 121. T124*a* is the temperature that may be measured in ° Kelvin by the first temperature sensor 124 located upstream of the DOC 105, and $K_{engine}$ is the flow coefficient through the internal combustion engine portion which measure mass per unit time at a certain temperature of a gas flowing in internal combustion engine portion, and similarly, $K_{engine}$ is dependent on a flow resistance inside the in internal combustion engine portion. $\dot{m}$ is a flow rate indicating gas mass flow through the exhaust aftertreatment system 100 and C may be seen as a constant C=148.7808. Once these parameters are obtained, the $P_{122a'}$ can be calculated accordingly. Therefore, to this end, it may be concluded that the upstream flow model is adapted to use: gas mass information indicative of a gas mass flow through the exhaust aftertreatment system 100, temperature information T124*a* indicative of an exhaust gas temperature at a position upstream the diesel particulate filter 106, the upstream pressure information and flow resistance information indicative of a flow resistance across the portion of the internal combustion engine system being located between the position at which the an exhaust gas pressure $P_{121}$ is determined and the diesel particulate filter 106 to determine an expected pressure $P_{122a'}$ upstream the DPF 106.

Once the expected pressure $P_{122a'}$ upstream the diesel particulate filter 106 and the expected pressure $P_{122b'}$ downstream the diesel particulate filter 106 are calculated using the above equations, the expected pressure difference ΔP' across the diesel particulate filter 106 can be determined as:

$$\Delta P' = P_{122a'} - P_{122b'}$$

The expected pressure difference ΔP' may be then used to determine whether a fault has occurred in the selective catalytic reducer assembly 20, as described in actions S3-5 and S3-6.

For the sake of completeness, it should be noted that in other examples of the method, the expected pressure difference ΔP' across the diesel particulate filter 106 need not be determined using the expected pressure $P_{122a'}$ upstream the diesel particulate filter 106 and the expected pressure $P_{122b'}$ downstream the diesel particulate filter 106. Instead, it is contemplated that in examples of the method, the expected pressure difference ΔP' across the diesel particulate filter 106 may be determined using a measured pressure $P_{122a}$ upstream the diesel particulate filter 106 and the expected pressure $P_{122b'}$ downstream the diesel particulate filter 106.

FIG. 5*a* is a graph of an expected pressure difference ΔP' across the diesel particulate filter 106 together with a measured pressure difference ΔP during operation of an engine at a condition under which no faults have occurred in the selective catalytic reducer assembly. The expected pressure difference ΔP' is indicated by the solid black line and the measured pressure ΔP is indicated by the hatched light grey line. As shown FIG. 5*a*, these lines are almost overlap with each other, meaning that the difference between the pressure difference information and the expected pressure difference information is within a predetermined difference range.

FIG. 6*a* is a graph of an expected pressure difference ΔP' across the diesel particulate filter 106 together with a measured pressure difference ΔP during operation of an engine at a condition under which a fault has occurred in the selective catalytic reducer assembly. Similarly, the expected pressure difference ΔP' is indicated by the solid black line and the measured pressure ΔP is indicated by the hatched light grey line. As shown FIG. 6*a*, these lines have an offset with each other, meaning that the difference between the pressure difference information and the expected pressure difference information is outside a predetermined difference range.

The present disclosure also relates to a computer program product comprising program code for performing, when executed by the processing circuitry, the method discussed above and a non-transitory computer-readable storage medium comprising instructions, which when executed by the processing circuitry, cause the processing circuitry to perform the method discussed above.

Moreover, the present disclosure may be exemplified by any one of the below examples and combination of examples.

Example 1

A computer-implemented method for detecting a fault in a selective catalytic reducer assembly (20) of an internal combustion engine system (10), the internal combustion engine system (10) comprises an internal combustion engine (101) and an exhaust aftertreatment system (100), the exhaust aftertreatment system (100) comprising:

a diesel particulate filter (106) adapted to receive exhaust gas from the internal combustion engine (101), and said selective catalytic reducer assembly (20) positioned downstream the diesel particulate filter (106), as seen in an intended direction of flow from the internal combustion engine (101) to the selective catalytic reducer assembly (20), the selective catalytic reducer assembly (20) comprising a selective catalytic reducer (107), the method comprising:

receiving (S1), by processing circuitry of a computer system, upstream pressure information indicative of an exhaust gas pressure ($P_{121}$) at a position upstream the diesel particulate filter (106), as seen in an intended direction of flow from the internal combustion engine (101) to the diesel particulate filter (106);

receiving (S2), by the processing circuitry, pressure difference information indicative of a pressure difference ($\Delta P$) across the diesel particulate filter (106), using (S3), by the processing circuitry, the upstream pressure information and the pressure difference information to determine whether or not a fault has occurred in the exhaust selective catalytic reducer assembly (20).

Example 2

The method according to Example 1, wherein the selective catalytic reducer assembly (20) further comprises a urea mix box (108) into which urea is adapted to be injected, said urea mix box (108) being positioned between the diesel particulate filter (106) and the selective catalytic reducer (107), as seen in an intended direction of flow from the diesel particulate filter (106) to the selective catalytic reducer (107).

Example 3

The method according to Example 1, wherein the internal combustion engine system (10) comprises an exhaust gas manifold (103) located between the internal combustion engine (101) and the diesel particulate filter (106), as seen in an intended direction of flow from the internal combustion engine (101) to the diesel particulate filter (106), the upstream pressure information being indicative of an exhaust gas pressure (P121) in said exhaust gas manifold (103).

Example 4

The method according to any one of Examples 1-3, wherein using the upstream pressure information and the pressure difference information to determine whether or not a fault has occurred in the selective catalytic reducer assembly (20) comprises:

using the upstream pressure information for determining an upstream pressure change rate value indicative of a rate of change of the exhaust gas pressure at the position upstream the diesel particulate filter, using the pressure difference information for determining a pressure difference change rate value indicative of a rate of change of the pressure difference across the diesel particulate filter (106), using the upstream pressure change rate value and the pressure difference change rate value for determining whether or not a fault has occurred in the selective catalytic reducer assembly (20).

Example 5

The method according to Example 4, wherein using the upstream pressure change rate value and the pressure difference change rate value for determining whether or not a fault has occurred in the selective catalytic reducer assembly (20), comprises:

in response to determining that a difference between the upstream pressure change rate value and the upstream pressure change rate value exceeds a predetermined threshold value, determining that a fault has occurred in the selective catalytic reducer assembly (20).

Example 6

The method according to any one of Examples 1-3, wherein using the upstream pressure information and the pressure difference information to determine whether or not a fault has occurred in the selective catalytic reducer assembly (20) comprises:

determining an expected pressure difference information indicative of a pressure difference ($\alpha P'$) across the diesel particulate filter (106) under a condition in which the selective catalytic reducer assembly (20) is not associated with the fault, in response to determining that a difference between the pressure difference information and the expected pressure difference information being outside a predetermined difference range, determining that a fault has occurred in the selective catalytic reducer assembly (20).

Example 7

The method according to Example 6, wherein the expected pressure difference information is determined using an expected pressure downstream said diesel particulate filter (106) using a selective catalytic reducer assembly flow model of at least a portion of the selective catalytic reducer assembly (20).

Example 8

The method according to Example 7, wherein the selective catalytic reducer assembly flow model is adapted to determine the expected pressure downstream said diesel particulate filter (106) and preferably upstream the selective catalytic reducer assembly (20), at the condition in which the selective catalytic reducer assembly (20) is not associated with the fault, the selective catalytic reducer assembly flow model being adapted to use: gas mass information indicative of a gas mass flow through the exhaust aftertreatment system (100), temperature information (T124*c*) indicative of an exhaust gas temperature at a position downstream the diesel particulate filter (106), a pressure (P125) downstream said at least a portion of the selective catalytic reducer assembly (20) and flow resistance information indicative of a flow resistance across at least a portion of the selective catalytic reducer assembly (20) at the condition in which the selective catalytic reducer assembly (20) is not associated with the fault.

Example 9

The method according to Example 7 or Example 8, wherein the expected pressure difference information is determined using a difference between a pressure upstream the diesel particulate filter (106) and the expected pressure downstream said diesel particulate filter (106).

Example 10

The method according to Example 9, wherein the pressure upstream said diesel particulate filter (106) is determined using the upstream pressure information indicative of an exhaust gas pressure (P121) at a position upstream the diesel particulate filter.

Example 11

The method according to Example 10, wherein the pressure upstream said diesel particulate filter (106) is an expected pressure upstream said diesel particulate filter (106) which is determined using the upstream pressure information and an upstream flow model of at least a portion of the internal combustion engine system (10) being located between a position at which the an exhaust gas pressure (P121) is determined and the diesel particulate filter (106).

Example 12

The method according to Example 11, wherein the upstream flow model is adapted to use: gas mass information indicative of a gas mass flow through the exhaust aftertreatment system (100), temperature information (T124*a*) indicative of an exhaust gas temperature at a position upstream the diesel particulate filter (106), the upstream pressure information and flow resistance information indicative of a flow resistance across the portion of the internal combustion engine system being located between the position at which the an exhaust gas pressure (P121) is determined and the diesel particulate filter (106).

Example 13

The method according to any one of the preceding Examples, wherein the pressure difference information is received from a second sensor (122) comprising:

a first sensor part (122*a*) positioned upstream, preferably at an entrance of, the diesel particulate filter (106) and configured to measure an upstream pressure ($P_{122a}$) of the exhaust gas entering the diesel particulate filter (106);

a second sensor part (122*b*) positioned downstream, preferably at an exit of, the diesel particulate filter (106) and configured to measure a downstream pressure ($P_{122b}$) of the exhaust gas exiting the diesel particulate filter (106), wherein the second sensor (122) is configured to output a pressure difference ($\Delta P$) being the difference between the upstream pressure ($P_{122a}$) and the downstream pressure ($P_{122b}$).

Example 14

The method according to any one of the preceding Examples, wherein the fault is related to clogging in a portion of the selective catalytic reducer assembly (20) due to a deposition of components, preferably a deposition of solids, inside that portion.

Example 15

A computer program product comprising program code for performing, when executed by the processing circuitry, the method of any of Examples 1-14.

Example 16

A non-transitory computer-readable storage medium comprising instructions, which when executed by the processing circuitry, cause the processing circuitry to perform the method of any of Examples 1-14.

The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, actions, steps, operations, elements, and/or components, but do not preclude the presence or addition of one or more other features, integers, actions, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the disclosure being set forth in the following claims.

The invention claimed is:

1. A method performed by a control unit of a vehicle for detecting clogging in a selective catalytic reducer assembly of an internal combustion engine system of the vehicle, the internal combustion engine system comprises an internal combustion engine and an exhaust aftertreatment system, the exhaust aftertreatment system comprising:

a diesel particulate filter adapted to receive exhaust gas from the internal combustion engine, and said selective catalytic reducer assembly positioned downstream the diesel particulate filter, as seen in an intended direction of flow from the internal combustion engine to the selective catalytic reducer assembly, the selective catalytic reducer assembly comprising a selective catalytic reducer, the method comprising:

receiving, by processing circuitry of the control unit, upstream pressure information indicative of an exhaust gas pressure at a position upstream the diesel particulate filter, as seen in an intended direction of flow from the internal combustion engine to the diesel particulate filter;

receiving, by the processing circuitry, pressure difference information indicative of a pressure difference across the diesel particulate filter, detecting, by the processing circuitry, based on the upstream pressure information and the pressure difference information that clogging has occurred in a portion of the exhaust selective catalytic reducer assembly due to accumulated solids in the portion, the detecting comprising:

determining an expected pressure difference information indicative of a pressure difference across the diesel particulate filter under a condition in which the selective catalytic reducer assembly is not associated with clogging, wherein the expected pressure difference information is determined based on an expected pressure downstream said diesel particulate filter generated by a selective catalytic reducer assembly flow model of at least a portion of the selective catalytic reducer assembly, in response to determining that a difference between the pressure difference information and the expected pressure difference information being outside a predetermined difference range, determining that clogging has occurred in the selective catalytic reducer assembly, and in response to determining that clogging has occurred in the selective catalytic reducer assembly, raising a temperature of the exhaust gas to induce active regeneration of the diesel particulate filter to burn off accumulated solids inside the diesel particulate filter.

2. The method according to claim 1, wherein the selective catalytic reducer assembly further comprises a urea mix box into which urea is adapted to be injected, said urea mix box being positioned between the diesel particulate filter and the selective catalytic reducer, as seen in an intended direction of flow from the diesel particulate filter to the selective catalytic reducer.

3. The method according to claim 1, wherein the internal combustion engine system comprises an exhaust gas manifold located between the internal combustion engine and the diesel particulate filter, as seen in an intended direction of flow from the internal combustion engine to the diesel particulate filter, the upstream pressure information being indicative of an exhaust gas pressure in said exhaust gas manifold.

4. The method according to claim 1, wherein using the upstream pressure information and the pressure difference information to determine whether or not a fault has occurred in the selective catalytic reducer assembly comprises:

using the upstream pressure information for determining an upstream pressure change rate value indicative of a rate of change of the exhaust gas pressure at the position upstream the diesel particulate filter, using the pressure difference information for determining a pressure difference change rate value indicative of a rate of change of the pressure difference across the diesel particulate filter, using the upstream pressure change rate value and the pressure difference change rate value for determining whether or not a fault has occurred in the selective catalytic reducer assembly.

5. The method according to claim 4, wherein using the upstream pressure change rate value and the pressure difference change rate value for determining whether or not a fault has occurred in the selective catalytic reducer assembly, comprises:

in response to determining that a difference between the pressure difference change rate value and the upstream pressure change rate value exceeds a predetermined threshold value, determining that a fault has occurred in the selective catalytic reducer assembly.

6. The method according to claim 1, wherein the selective catalytic reducer assembly flow model is adapted to determine the expected pressure downstream said diesel particulate filter and upstream the selective catalytic reducer assembly, at the condition in which the selective catalytic reducer assembly is not associated with a fault, the selective catalytic reducer assembly flow model being adapted to use: gas mass information indicative of a gas mass flow through the exhaust aftertreatment system, temperature information indicative of an exhaust gas temperature at a position downstream the diesel particulate filter, a pressure downstream said at least a portion of the selective catalytic reducer assembly and flow resistance information indicative of a flow resistance across at least a portion of the selective catalytic reducer assembly at the condition in which the selective catalytic reducer assembly is not associated with the fault.

7. The method according to claim 1, wherein the expected pressure difference information is determined using a difference between a pressure upstream the diesel particulate filter and the expected pressure downstream said diesel particulate filter, optionally wherein the pressure upstream said diesel particulate filter is determined using the upstream pressure information indicative of an exhaust gas pressure at a position upstream the diesel particulate filter.

8. The method according to claim 7, wherein the pressure upstream said diesel particulate filter is an expected pressure upstream said diesel particulate filter which is determined using the upstream pressure information and an upstream flow model of at least a portion of the internal combustion engine system being located between a position at which the an exhaust gas pressure is determined and the diesel particulate filter.

9. The method according to claim 8, wherein the upstream flow model is adapted to use: gas mass information indicative of a gas mass flow through the exhaust aftertreatment system, temperature information indicative of an exhaust gas temperature at a position upstream the diesel particulate filter, the upstream pressure information and flow resistance information indicative of a flow resistance across the portion of the internal combustion engine system being located between the position at which the an exhaust gas pressure is determined and the diesel particulate filter.

10. The method according to claim 1, wherein the pressure difference information is received from a sensor comprising:

a first sensor part positioned upstream of the diesel particulate filter and configured to measure an upstream pressure of the exhaust gas entering the diesel particulate filter;

a second sensor part positioned downstream of the diesel particulate filter and configured to measure a downstream pressure of the exhaust gas exiting the diesel particulate filter, wherein the sensor is configured to output a pressure difference being the difference between the upstream pressure and the downstream pressure.

11. A non-transitory computer-readable storage medium comprising instructions, which when executed by the processing circuitry, cause the processing circuitry to perform the method of claim 1.

12. The method according to claim 1, further comprising:

raising a temperature of the exhaust gas to burn off the accumulated solids.

13. The method according to claim 1, further comprising:

adding a reductant to the exhaust gas upstream of the selective catalytic reducer.

* * * * *